US009114896B2

(12) United States Patent
Sorrentino

(10) Patent No.: US 9,114,896 B2
(45) Date of Patent: Aug. 25, 2015

(54) COILING PIPES IN SPOOL FORM AND TYING SAID SPOOL

(71) Applicant: F.B. BALZANELLI AVVOLGITORI S.P.A., Milan (IT)

(72) Inventor: Marco Sorrentino, Milan (IT)

(73) Assignee: F.B. BALZANELLI AVVOLGITORI S.P.A., Milan (IT)

( * ) Notice: Subject to any disclaimer, the term of this patent is extended or adjusted under 35 U.S.C. 154(b) by 0 days.

(21) Appl. No.: 14/298,305

(22) Filed: Jun. 6, 2014

(65) Prior Publication Data

US 2014/0360131 A1 Dec. 11, 2014

(30) Foreign Application Priority Data

Jun. 7, 2013 (IT) ..... MI2013A0945

(51) Int. Cl.
*B65B 27/06* (2006.01)
*B65H 54/62* (2006.01)

(52) U.S. Cl.
CPC ..... *B65B 27/06* (2013.01); *B65H 54/62* (2013.01); *B65H 2701/33* (2013.01)

(58) Field of Classification Search
CPC ..... B65B 13/10; B65B 13/04; B65B 13/14; B65B 25/24; B65B 27/06; B65H 54/58; B65H 54/585; B65H 54/62; B65H 75/24; B65H 2701/33; B21C 47/28; B21C 47/30
USPC ..... 100/12, 25, 26
See application file for complete search history.

(56) References Cited

U.S. PATENT DOCUMENTS 5,540,142 A * 7/1996 Mieleszuk et al. ..... 100/4
6,701,831 B2 * 3/2004 Jones et al. ..... 100/3

FOREIGN PATENT DOCUMENTS

DE 4142262 A1 1/1993
GB 2228469 A 8/1990
WO WO-2010103336 A1 9/2010

* cited by examiner

*Primary Examiner* — Jimmy T Nguyen
(74) *Attorney, Agent, or Firm* — Mintz Levin Cohn Ferris Glovsky and Popeo, P.C.

(57) ABSTRACT

A machine for coiling pipes in the form of large-size heavy spools includes a reel rotating about a longitudinal axis for coiling the pipes fed to the reel in a feeding direction, the reel including: a first rotating half-reel; a second half-reel coaxial with and arranged opposite the first half-reel in the longitudinal direction; said first and second half-reels being displaceable in both senses of the longitudinal direction from a relative position where the two half-reels are closed in contact with each other in the longitudinal direction for coiling the spool, to a position where the two half-reels are separated from each other for unloading the finished and tied spool; and an assembly for tying the spool using a strap.

9 Claims, 4 Drawing Sheets

COILING PIPES IN SPOOL FORM AND TYING SAID SPOOL

CROSS-REFERENCE TO RELATED APPLICATION

This application claims priority to Italian Patent Application No. MI2013A000945 filed on Jun. 7, 2013, the contents of which are hereby expressly incorporated by reference herein in their entirety.

FIELD

The present subject matter relates to a machine for coiling pipes in the form of large-size and heavy spools with tying of the finished spool by means of straps, provided with a rotating reel formed by two half-reels arranged opposite each other and displaceable along the axis of rotation of the said reel.

BACKGROUND

It is known in the technical sector of winding pipes in the form of shanks, reels and the like that said pipes are obtained by winding the reels using coiling machines provided with a rotating reel, the rotating part of which comprises: a drum, rotating about an axis of rotation and formed by circle segments, or "bar elements," which are parallel to the axis of rotation and displaceable radially from/towards said axis on respective radial arms for adjusting the internal diameter of the spool; and a cross journal, which is formed by radial arms and flanges and is displaceable parallel to the axis of rotation for adjusting the height of the spool. Also known in the art are different models of coilers for automatically coiling pipes made of plastic and other materials, which operate with a completely automatic cycle comprising essentially the following steps:

automatically taking up the pipe to be wound on the reel by means of a corresponding mechanical device;

automatically starting the coiling operation, during which a pipe-guiding device distributes the pipe on the rotating reel;

automatically cutting the pipe when the set winding length is reached;

starting the tying operations for preparing the finished spool;

automatically unloading the wound and tied spool.

It is also known that the rotating reel is secured to the base structure of the machine on one side only and that consequently, during the pipe coiling procedure, the spool being coiled and/or the completed spool is supported in a cantilevered manner by the circle segments (bar elements) of the rotating drum of the reel, such that its weight bears entirely on the said bar elements and, consequently, on the reel structure, with generation of high flexural moments on the bar elements and on the corresponding radial supporting arms thereof. Said moments generated by the cantilevered mass of the reel and the spool frequently result in breakages and/or structural failures of the various reel components. Therefore this configuration of the coiling machine requires continuous adjustment and repairs which result in machine stoppages and inconvenience, with a consequent increase in the corresponding direct costs and final cost of the spool.

A further problem associated with the machines according to the prior art consists in the fact that the aforementioned reel structure tends to have an adverse effect on the end result of the coiling process, resulting in spools which are not perfectly coiled and/or uniform, since the spool being wound with its weight projecting on the reel generates flexural forces on the bar elements and axial misalignment of the winding drum.

The aforementioned reel structure according to the prior art also results in limitation of the final width which may be obtained for the wound spools which may not exceed the limits imposed by the structural strength of the reel in relation to the aforementioned flexural forces and, in addition, coaxial unloading of the spool is made difficult in the known machines.

WO 2010/103336 also discloses a coiling machine for small-diameter pipes which envisages wrapping the finished (small-size and low-weight) spool with stretch film before it is unloaded. The introductory part of the patent application contains an analysis of the machines for coiling larger-diameter pipes in the form of large-size and heavy spools which require tying by means of straps. The machine described in WO2010/103336 consists in particular of a coiling machine for small-size pipes and spools which are wrapped with a film having a width greater than the width of the spool so that the spool is wound by the film also laterally. The machine comprises a reel which is divided into two half-reels, each provided with elements for laterally retaining the spool, which elements must be folded down/retracted during rotation for winding the wrapping film, so as to allow the latter to pass through without breakages and/or tearing. For practical reasons, however, large-size and heavy spools cannot be wrapped with film.

SUMMARY

The technical problem which is posed, therefore, is that of providing a coiling machine designed to allow automatic coiling of pipes in the form of large-size and heavy spools and providing a solution to the problems abovementioned, whereby said machine in particular can be suitable for tying spools by means of straps, automatically and without the need for preliminary unloading of the spool from the coiling machine.

These results and others can be obtained according to the present subject matter by a machine for coiling pipes in the form of large-size and heavy spools, comprising a reel rotating about a longitudinal axis for coiling the pipes fed to the reel in a feeding direction, the reel comprising:

a first rotating half-reel a second half-reel coaxial with and arranged opposite the first half-reel in the longitudinal direction; said first and second half-reels being displaceable in both senses of the longitudinal direction from a relative position where the two half-reels are closed in contact with each other in the longitudinal direction for coiling the spool, to a position where the two half-reels are separated from each other for unloading the finished and tied spool;

the machine also comprises:

an assembly for tying the spool by means of a strap, comprising first inner semi-channels connected to each half-reel in predefined angular positions thereof;

at least one first and one second outer semi-channel which are rotationally fixed, respectively connected to the first half-reel and the second half-reel in a predefined angular position thereof, axially detached from each other and axially displaceable in the longitudinal direction together with the two half-reels;

a tying unit for operation of the strap, connected to the channels;

according to the characteristic features of the present subject matter.

Example embodiments are described in the claims which are fully cited herein.

DESCRIPTION OF DRAWINGS

Further details may be obtained from the following description of a non-limiting example embodiment of the present subject matter, provided with reference to the accompanying drawings, in which.

DETAILED DESCRIPTION

Figure 1:
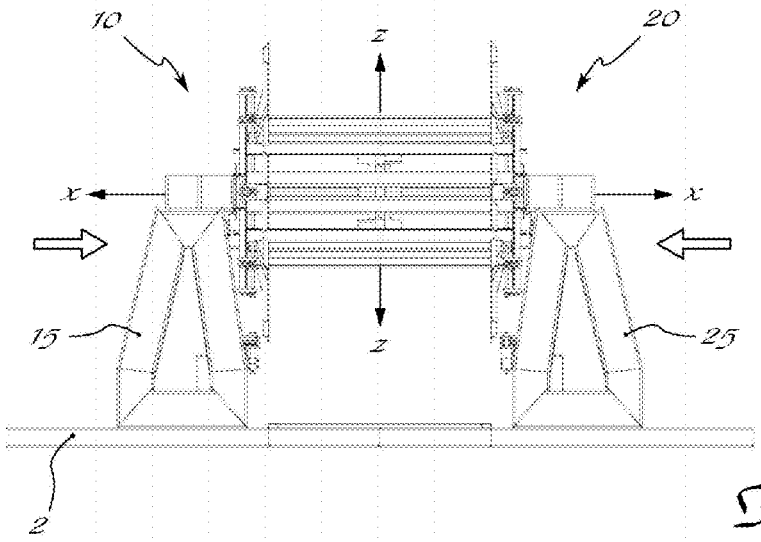
FIG. 1 shows a schematic front view of a machine for coiling pipes in spool form according to the present subject matter in the closed configuration for coiling.
Figure 2:
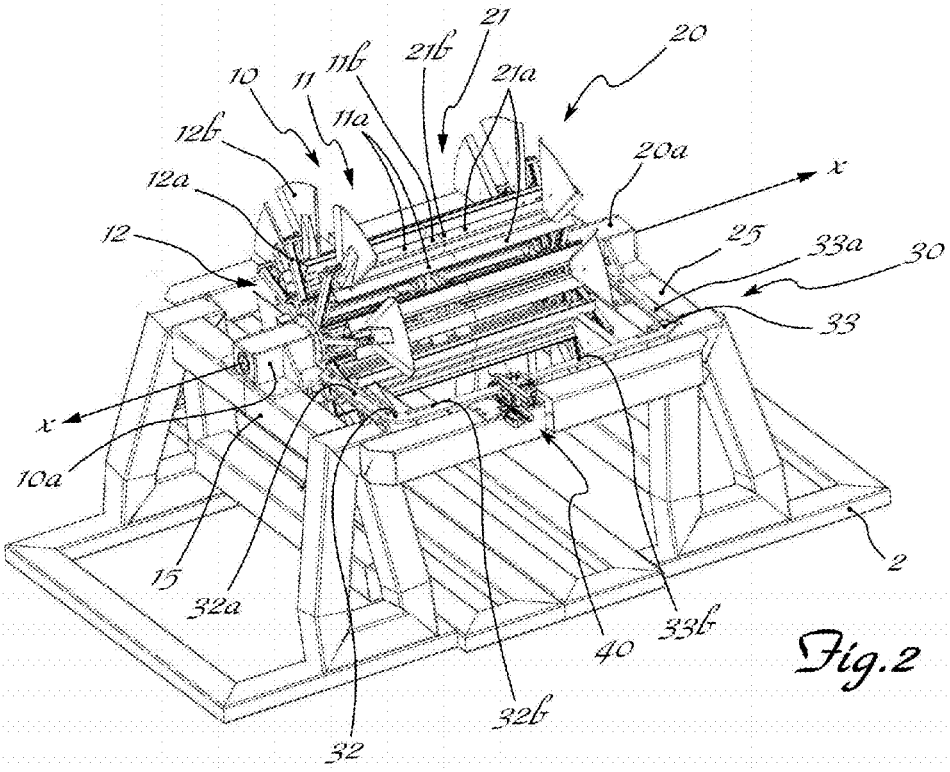
FIG. 2 shows a partial perspective view of the machine according to FIG. 1 with a detail of the reel and the channels for guiding the straps for tying the finished spool.
Figure 3:
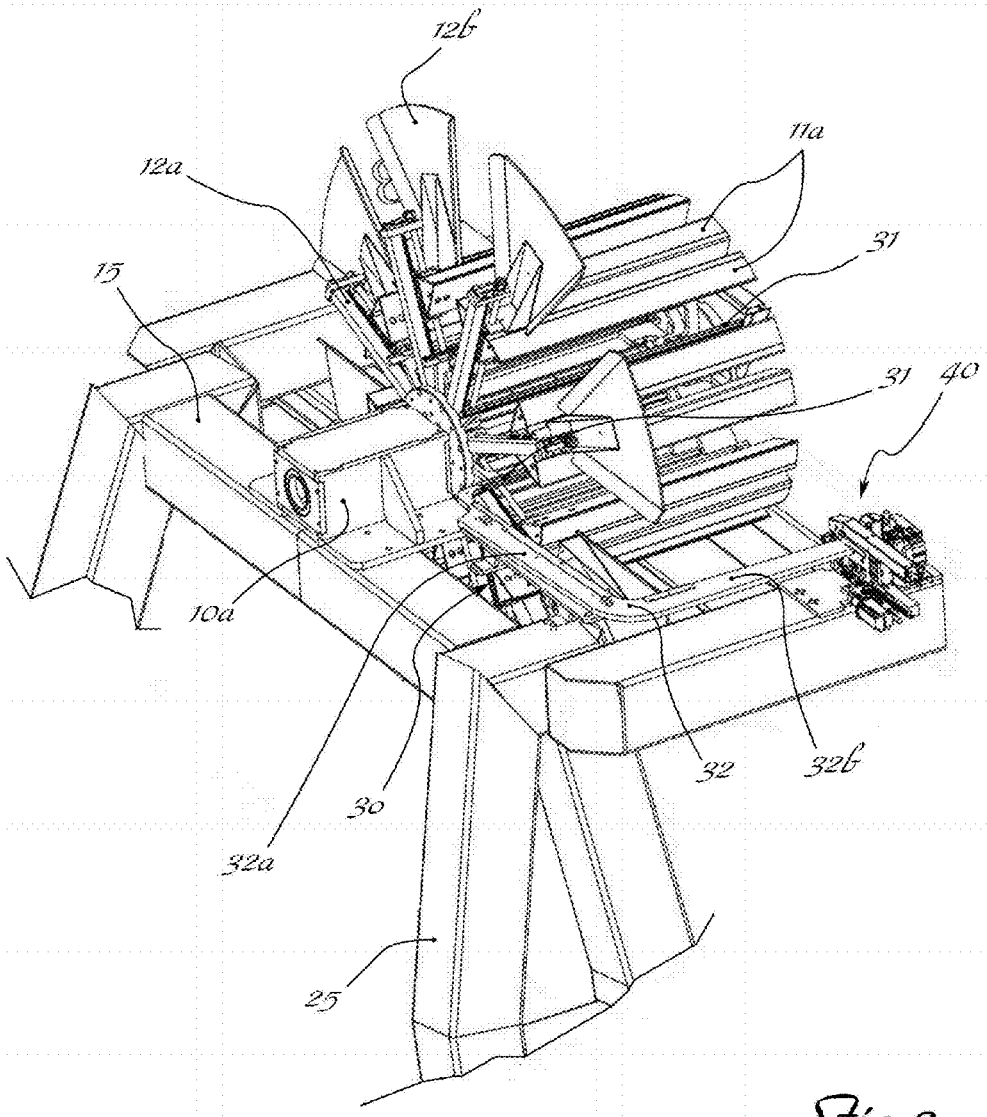
FIG. 3 shows a partial perspective view of one of the two half-reels according to FIG. 2 and the channels for guiding the straps for tying the finished spool.
Figure 4:
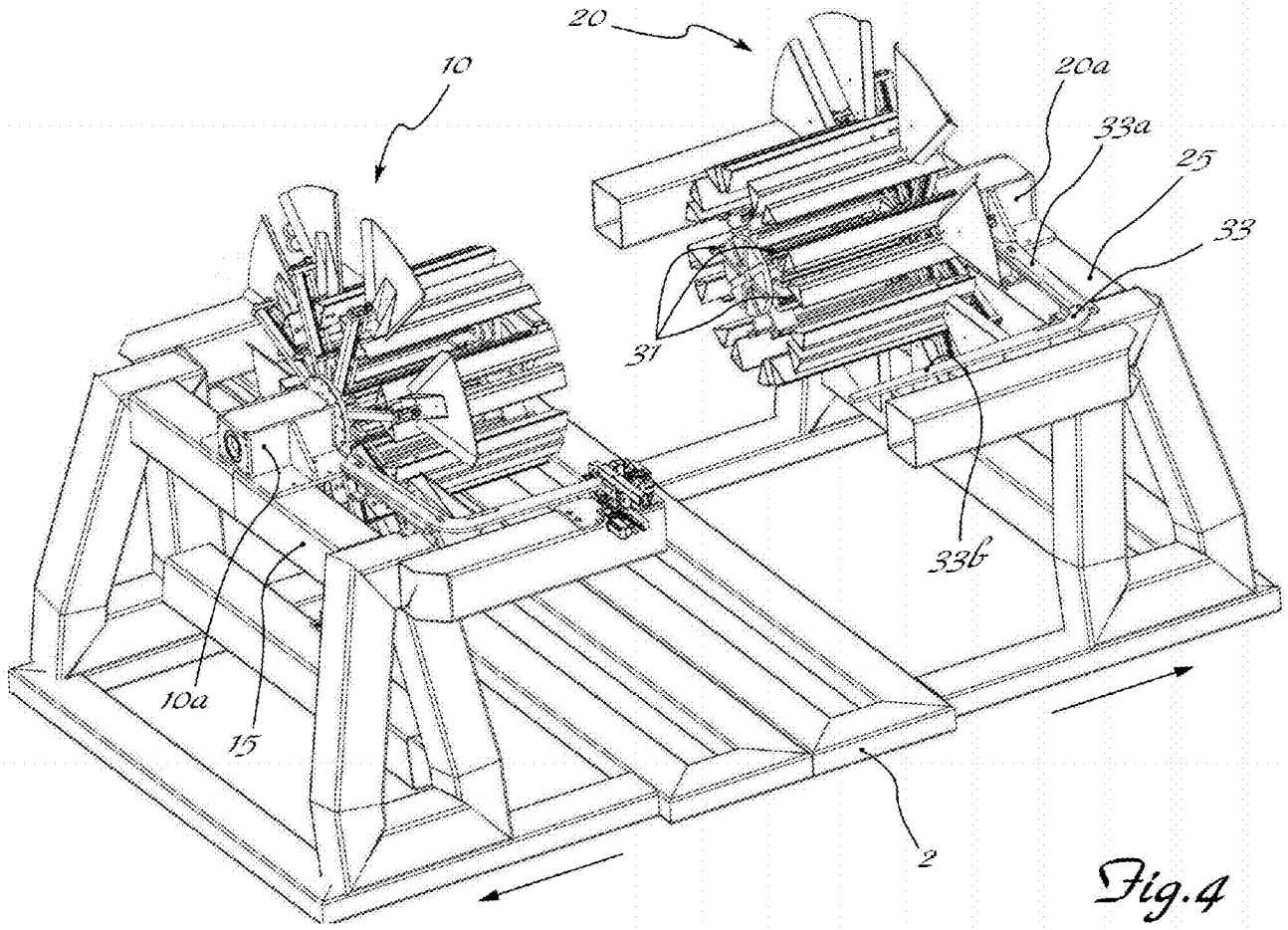
FIG. 4 shows a schematic front view of the machine according to FIG. 1 in the open configuration for unloading the wound and tied spool.

As shown in FIGS. 1-4 and assuming solely for the purposes of simpler description and without a limiting meaning a set of three reference axes, respectively in the longitudinal direction X-X corresponding to the axis of rotation of the reel, transverse direction Y-Y, corresponding to the direction of feeding the pipes, and vertical direction Z-Z, perpendicular to the other two directions, an example embodiment of a machine for coiling pipes 1 according to the present subject matter can include substantially:

a first rotating half-reel 10, one end 10*a* of which is mounted on a support 15 connected to one side of the fixed base 2 of the machine; said half-reel 10 can include:

a first central half-drum 11, rotating about the axis of axial rotation X-X and can be formed by:

longitudinal circle segments, or "bar elements", 11*a*, which can be mounted on radial arms and can be movable thereon in both senses of the radial direction from a minimum open position, close to the axis of rotation X-X, to a fully open position, far from the said axis of rotation, where the various positions can correspond to the predefined inner diameter of the spool to be coiled;

a first cross journal 12 which can be mounted on said first half-drum 11 and formed by radial arms 12*a* each of which can carry a respective flange 12*b* commonly called a petal; said arms 12*a* with the respective flanges 12*a* which can be movable in both senses of the longitudinal direction X-X so as to move the flanges 12*b* to the position corresponding to the predefined half-height of the finished spool in the longitudinal direction X-X, in such a way as to retain said spool during coiling of the pipe; and a second half-reel 20 which can be coaxial with and can be situated opposite the first half-reel 10 in the longitudinal direction X-X and one end 20*a* of which can be mounted on a second support 25 connected to the fixed base 2 of the machine on the opposite side to the first half-reel 10 relative to the central plane of symmetry Y-Z of the machine.

In a similar manner to the first half-reel 10, the second half-reel 20 can be formed by a respective cross journal 22 formed by radial arms 22*a* which can carry a corresponding petal 22*a*; in a similar manner to the first half-reel 10 the arms 22*a* can be movable in both senses of the longitudinal direction X-X so as to move the flanges 22*b* to the position corresponding to the predefined half-height of the finished spool in the longitudinal direction X-X, so as to retain the spool during winding of a pipe; the half-reel 20 also can have a half-drum 21 with radial arms having, connected thereto, longitudinal bar elements 21*a* movable on the said arms in both senses of the radial direction from a minimum open position, close to the axis of rotation X-X, to a fully open position, far from the said axis of rotation, the various positions can correspond to the predefined inner diameter of the spool to be wound.

The two half-reels 10;20 can be movable with respect to each other by means of the respective support 15;25 of the fixed base 2, in both senses of the longitudinal direction X-X from a relative closed position, axially close to the central plane of symmetry Y-Z of the machine, where the two reels can be axially closed in contact with each other for coiling the spool, to an open position, which is axially distant from the central plane of symmetry Y-Z, where the two half-reels 10;21 are separated from each other for centrally unloading the wound and tied spool.

The two half-reels 10, 20 are such that, when they are located in the closed position, the free ends 11*b*;21*b* of the respective bar elements 11*a*;21*a* can be rigidly joined together in contact with each other so as to form a single body, which is constrained at the opposite ends to the respective support 15,25. This joint may be achieved using a technique, for example by means of a male/female interlocking joint, or the like, able to produce a constraint both in relation to the relative rotation of the two half-reels and in relation to the weight of the spool.

The two half-reels 10;20 may be displaceably operated independently of each other in the longitudinal direction X-X, but, in an example embodiment, the displacement in the longitudinal direction X-X which results in joining together of the free ends 11*b*;21*b* of the respective bar elements 11*a*;21*a*, can be symmetrical and synchronized by suitable electronic control, adjusting and operating means.

Also the rotation of the two half-reels 10;20 about the longitudinal axis X-X may be independent and synchronized by suitable electronic adjusting means for correct winding of the spool and efficient operation of the machine; it is envisaged however that, in an example embodiment, one of the two half-reels can be motorized and the other one can be idle so as to be rotationally driven by the first half-reel, once the two are axially engaged with each together.

The machine according to the present subject matter envisages however devices 30,40 (FIGS. 2,4) for tying the finished spool, by means of straps, which can be integrated with the two half-reels 10,20 and with the movements thereof. The tying devices can include a tying unit 40 (not shown in all its details) which can be the apparatus which intervenes, once coiling has finished, in order to perform a plurality of operations for tying of the spool along its height (axis X-X); each tying operation can be performed using a continuous strap which can be unwound from a roll, passed through jockey rollers that can act as a flywheel, and can be fed to the spool via a group of guide channels inside which it slides being pushed by two external motor-driven rollers; for the tying operation, the strap encircles the spool, forming a loop, which at this stage can still be loose and the free end of which can return to the starting point, entering into a gripping, welding and cutting device; at the same time the tying unit advances causing pulling of the strap and therefore closing of the loop around the spool; during the advancing movement the excess strap portion of the free end of the loop can again be recovered by the jockey rollers which can assume again the initial position, preparing the whole assembly for a new tying operation in a different position, determined by a suitable rotation of the reel.

This tying operation can be made possible by the channel assembly 30 which can include (e.g., shown in FIG. 3) a plurality of inner semi-channels distributed over various angular positions of each rotating half-reel 10,20, so that they can remain always effectively inside the spool which, rotating, moves in succession each inner channel opposite the outer semi-channels 32, 33 which can be instead arranged in a fixed angular position with respect to the two half-reels, so as to form the closed ring for guiding the strap during each tying operation.

In greater detail, the inner channels 31 can have an I-shaped form parallel to the longitudinal axis X-X, while the outer channels 32,33 have a substantially L-shaped form with respective arms 32*b*,33*b* parallel to the longitudinal axis X-X and arms 32*a*,33*a* substantially at right angles to the latter and with their free end directed towards the reel and able to be connected to the inner channel 31 present in the angular tying position. The two outer semi-channels 32,33 can be axially detached from each other so that they can move together with the respective half-reel 10,20.

Figure 5:
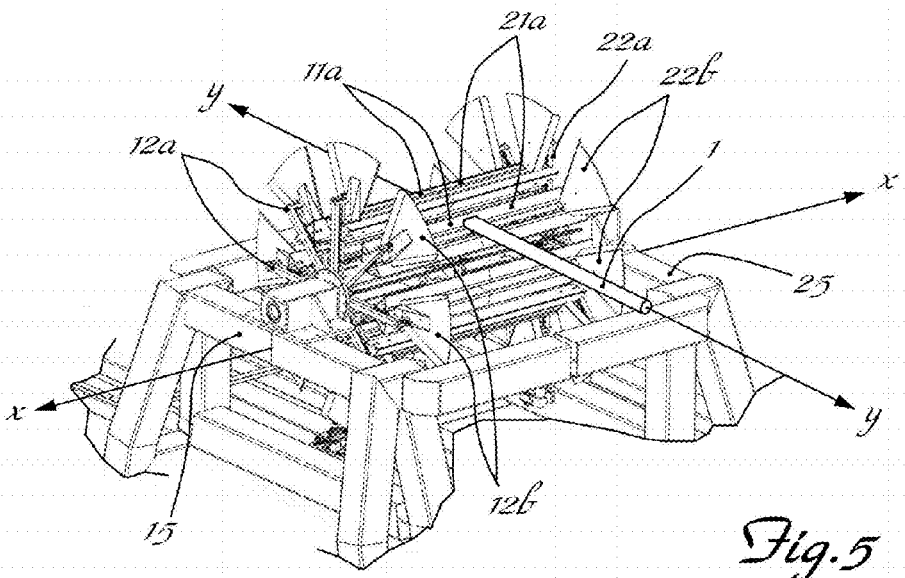
FIG. 5 shows a schematic perspective view of the machine according to the present subject matter during coiling.
Figure 6:
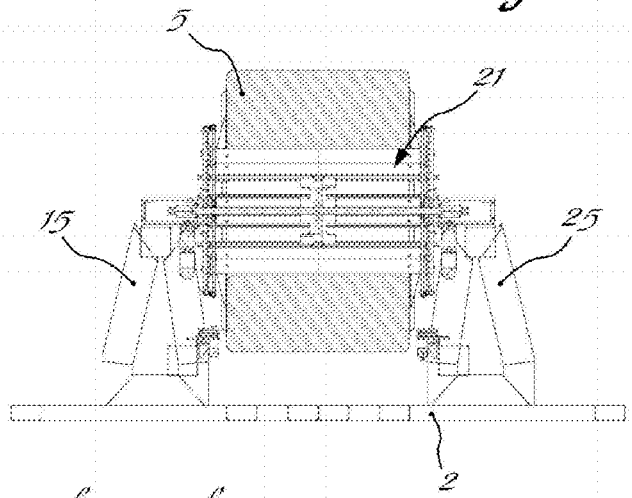
FIG. 6 shows a perspective view of the machine according to FIG. 5 with the spool sectioned at the end of coiling.
Figure 7:
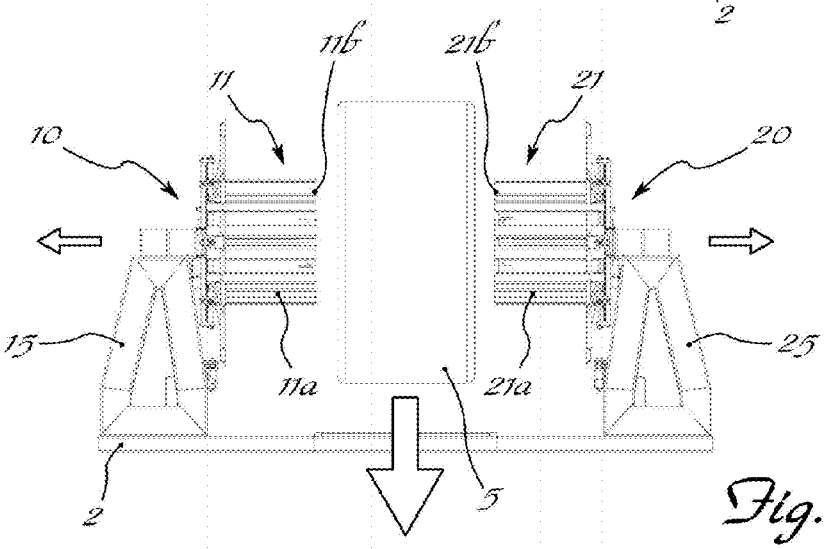
FIG. 7 shows a front view from the pipe entry side of the machine according to FIG. 6 with the reel open for central unloading of the tied spool.

With the configuration described above operation of the machine can be as follows:

at the start of the cycle the two half-reels 10;20 can be located in the closed coiling position (FIG. 1,2) with the free oppositely arranged ends 11*b*,21*b* of the bar elements 11*a*, 21*a* of each half-reel 10,20 joined together in the longitudinal direction.

in this position the inner semi-channels 31 can be axially joined together forming a single guide channel for the subsequent strap tying operation;

the radial opening of the bar elements 11*a*;21*a* of the two half-reels 10;20 can be adjusted depending on the predefined internal diameter of the finished spool;

the relative axial position of the cross journals 12;22 of each half-reel 10;20 can be adjusted depending on the predefined height of the finished spool;

the pipe 1 can be fed to the closed reel and coiling thereof can be started (FIG. 5,6);

once coiling has been completed, the tying cycle can be started, bringing in controlled sequence each inner channel 31 of the reel into the angular position corresponding to the outer L-shaped channels 32,33 connected to the tying assembly 40;

in each angular tying position, tying can be started by means of the unit 40 with feeding of the strap which, guided by the circuit defined by the inner channels 31 and the outer channels 32,33, can tie the spool in the various predefined angular positions of the latter;

once tying has been completed, the bar elements 11*a*,21*a* of the half-reels 10;20 can be displaced radially towards the axis of rotation X-X and the two half-reels 10;20 can be moved in the longitudinal direction X-X from the position close together, for relative closing, to the separated position, for relative opening of the two half-reels 10,20 and the outer channels 32,33, so as to allow unloading of the wound and tied spool 5 which is thus free to come out in the vertical direction Z-Z centrally between the two half-reels 10;20 (FIG. 7) and be removed and/or conveyed outside of the machine in the feeding direction Y-Y and on the opposite side to that for feeding the pipe 1.

Although described as a manual sequence, it is envisaged that all the movements and synchronized operation thereof can be programmed and controlled by means of a processing unit 500—schematically indicated by means of a broken line in FIG. 1—which can control all the servomechanisms and can send commands upon receiving corresponding signals from the various position sensors and timers with which the machine is conventionally equipped.

It is therefore clear how with the coiling reel according to the present subject matter it is possible to support the weight of the spool being wound on both sides, which may reduce or eliminate the problems associated with coiling in a projecting arrangement which would prevent the formation of spools large in size (external dimensions of up to 4 m) and of heavy weight (up to 6000 kg), incorporating at the same time the strap tying devices which can allow tying of the spool on the machine automatically and without prolonging the production cycle time. In addition, the two half-reels, pressing against each other during the coiling operation, can eliminate the flexing moment which is produced as a result of the weight of the spool.

Although described in connection with a number of embodiments and a number of preferred examples of embodiment of the present subject matter, it is understood that the scope of protection of the present disclosure will be determined by any claims that may issue with respect thereto.

The invention claimed is:

1. A coiling machine for coiling pipes in a form of large-size heavy spools, comprising:

a reel rotating about a longitudinal axis for coiling the pipes fed to the reel in a feeding direction, wherein said reel comprises:

a first rotating half-reel;

a second half-reel coaxial with and arranged opposite the first rotating half-reel in the longitudinal direction;

said first rotating half-reel and the second half-reel being displaceable in both senses of the longitudinal direction from a relative position where the two half-reels are closed in contact with each other in the longitudinal direction for coiling the large-size heavy spools, to a position where the two half-reels are separated from each other for unloading the large-size heavy spools; and wherein the coiling machine further comprises:

an assembly for tying the large-size heavy spool by means of a strap, the assembly comprising:

first inner semi-channels connected to each half-reel in predefined angular positions thereof;

at least one first and one second outer semi-channels which are rotationally fixed, respectively connected to the first rotating half-reel and the second half-reel in a predefined angular position thereof, axially detached from each other and axially displaceable in the longitudinal direction together with the two half-reels;

a tying unit for operation of the strap, connected to the first inner semi-channels and at least one first outer semi-channel.

2. The coiling machine according to claim 1, wherein each of said first rotating half-reel and the second half-reel has an end mounted on a support displaceable in both senses of the longitudinal direction.

3. The coiling machine according to claim 1, wherein each of the two half-reels comprises:

a half-drum formed by arms having, connected thereto, longitudinal bar elements for supporting the pipes which are movable on the said arms in both senses of a radial direction from a closed position, close to an axis of rotation, to a fully open position, far from the axis of rotation.

4. The coiling machine according to claim 1, wherein each of the two half-reels comprises a cross journal mounted on the respective half-drum and formed by respective radial arms which carry flanges for axially containing and adjusting a height of the spool, said cross journals being movable in both senses of the longitudinal direction.

5. The coiling machine according to claim 3, wherein in the closed position of the two half-reels, free ends of the respective oppositely arranged bar elements of the two half-reels are axially rigidly joined together in contact with each other, forming a single body constrained at its opposite ends.

6. The coiling machine according to claim 1, wherein said first inner semi-channels have a form of an "I" parallel to the longitudinal axis.

7. The coiling machine according to claim 1, wherein the at least one first and second outer semi-channels have a substantially L-shaped form with respective arms parallel to the longitudinal axis and arms at right angles to the latter and with their free ends directed towards the reel and suitable for connection to the first inner semi-channels present in an angular tying position.

8. The coiling machine according to claim 7, wherein the at least one first and second outer semi-channels are arranged in a fixed angular position with respect to the two half-reels so as to form a closed ring for guiding the strap during each tying operation.

9. The coiling machine according to claim 1, further comprising a fixed base and wherein the said first rotating half-reel and the second half-reel of the reel are oppositely arranged with respect to a central plane of symmetry of the coiling machine and are mounted on a respective support displaceable on the fixed base in both senses of the longitudinal direction.

* * * * *